US011619068B2

(12) United States Patent
Tuovinen

(10) Patent No.: US 11,619,068 B2
(45) Date of Patent: Apr. 4, 2023

(54) LOCK

(71) Applicant: Abloy Oy, Joensuu (FI)

(72) Inventor: Jyrki Tuovinen, Ylämylly (FI)

(73) Assignee: ABLOY OY, Joensuu (FI)

( * ) Notice: Subject to any disclaimer, the term of this patent is extended or adjusted under 35 U.S.C. 154(b) by 345 days.

(21) Appl. No.: 17/251,898

(22) PCT Filed: May 14, 2019

(86) PCT No.: PCT/FI2019/050379
§ 371 (c)(1),
(2) Date: Dec. 14, 2020

(87) PCT Pub. No.: WO2020/002760
PCT Pub. Date: Jan. 2, 2020

(65) Prior Publication Data

US 2021/0115701 A1 Apr. 22, 2021

(30) Foreign Application Priority Data

Jun. 15, 2018 (FI) ..... 20185545

(51) Int. Cl.
*E05B 17/04* (2006.01)
*E05B 15/10* (2006.01)
(Continued)

(52) U.S. Cl.
CPC ..... *E05B 17/048* (2013.01); *E05B 15/102* (2013.01); *E05B 15/1614* (2013.01);
(Continued)

(58) Field of Classification Search
CPC .... E05B 15/10; E05B 15/102; E05B 15/1614; E05B 17/04; E05B 17/041; E05B 17/048;
(Continued)

(56) References Cited

U.S. PATENT DOCUMENTS 2,004,434 A 6/1935 Gerald
3,971,239 A * 7/1976 Lavis ..... E05B 63/0017 292/1.5
(Continued)

FOREIGN PATENT DOCUMENTS

CL 48624 B1 9/2005
CL 46834 B1 12/2006
(Continued)

*Primary Examiner* — Christopher J Boswell
(74) *Attorney, Agent, or Firm* — Muncy, Geissler, Olds & Lowe, P.C.

(57) ABSTRACT

The lock according to the invention is meant for locking cabinets, vaults and different machines. The lock has a lock frame, which comprises a bolt. A lock cylinder has been arranged in connection with the lock frame. The lock frame further comprises a power transmission mechanism between the lock cylinder and the bolt. The power transmission mechanism comprises a transmission lever and a latch. The transmission lever additionally comprises a retaining protrusion. The bolt comprises a locking pin and the lock frame additionally comprises a hole for the locking pin. The lock is arranged to allow movement of the lock cylinder and the power transmission mechanism in the direction of the longitudinal axis of the lock cylinder due to an external hit or drilling of the lock cylinder, whereby the movement in the direction of the longitudinal axis moves the retaining protrusion away from the locking pin. Thus, the end of the locking pin moves into the hole in the frame.

9 Claims, 4 Drawing Sheets

Figure 4:
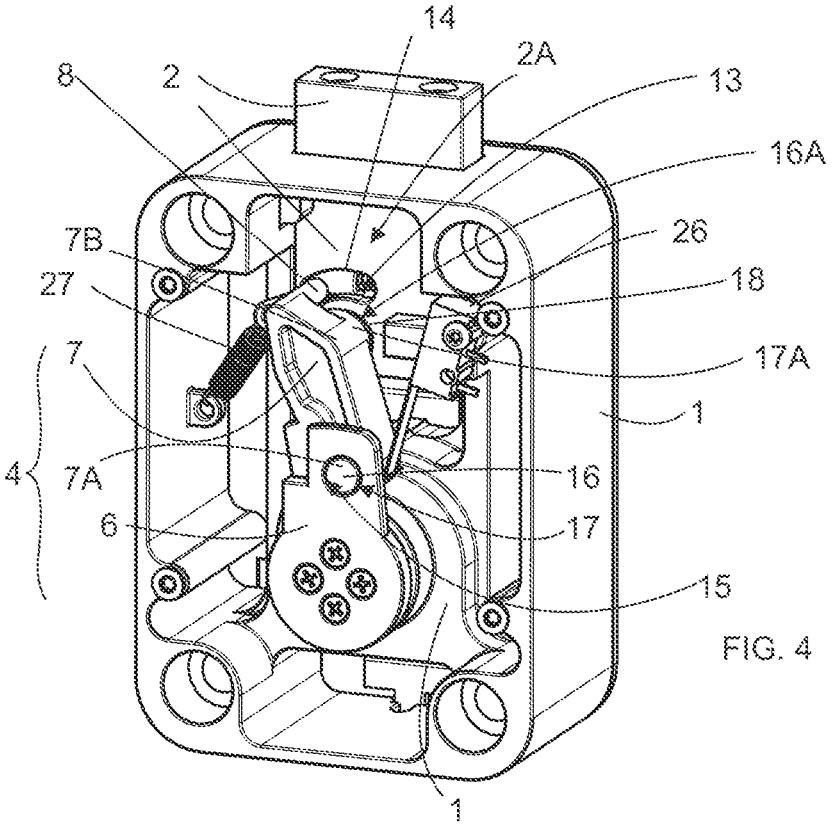

(51) Int. Cl.

| | |
|---|---|
| ***E05B 55/00*** | (2006.01) |
| ***E05B 15/16*** | (2006.01) |
| ***E05B 17/20*** | (2006.01) |
| ***E05B 63/12*** | (2006.01) |
| ***E05B 65/00*** | (2006.01) |
| ***E05B 15/12*** | (2006.01) |
| ***E05B 65/44*** | (2006.01) |

(52) U.S. Cl.
CPC ..... *E05B 17/04* (2013.01); *E05B 17/2007* (2013.01); *E05B 17/2023* (2013.01); *E05B 17/2084* (2013.01); *E05B 17/2092* (2013.01); *E05B 55/00* (2013.01); *E05B 63/126* (2013.01); *E05B 65/0082* (2013.01); *E05B 65/44* (2013.01)

(58) Field of Classification Search
CPC .. E05B 17/20; E05B 17/2007; E05B 17/2019; E05B 17/2023; E05B 17/2084; E05B 55/00; E05B 63/126; E05B 65/0082; E05B 65/44; E05B 65/46
See application file for complete search history.

(56) References Cited

U.S. PATENT DOCUMENTS

| | | | | |
|---|---|---|---|---|
| 4,183,565 | A * | 1/1980 | Allemann | E05B 65/104 292/150 |
| 5,297,404 | A | 3/1994 | Embry | |
| 5,622,065 | A * | 4/1997 | Persiano | E05B 17/2057 70/105 |
| 5,657,652 | A * | 8/1997 | Martin | E05B 65/46 70/81 |
| 6,199,922 | B1 * | 3/2001 | Kibble | E05B 63/18 292/DIG. 52 |
| 6,293,131 | B1 * | 9/2001 | Lemettinen | E05B 47/0603 292/DIG. 60 |
| 6,547,290 | B1 * | 4/2003 | Zenner | E05B 9/00 292/DIG. 31 |
| 9,284,750 | B2 * | 3/2016 | Maeng | E05B 55/00 |
| 9,416,563 | B1 | 8/2016 | Wind et al. | |
| 2005/0061043 | A1 | 3/2005 | Widen | |
| 2007/0257773 | A1 | 11/2007 | Hill et al. | |
| 2012/0255333 | A1 | 10/2012 | Mackay et al. | |

FOREIGN PATENT DOCUMENTS

| | | | |
|---|---|---|---|
| CL | 49065 | B1 | 2/2007 |
| CL | 53513 | B1 | 6/2007 |
| CL | 2010001640 | A1 | 3/2011 |
| CL | 2014000018 | A1 | 8/2014 |
| CL | 2015002800 | A1 | 3/2016 |
| CN | 2417256 | Y | 1/2001 |
| CN | 201495869 | U | 6/2010 |
| CN | 102027178 | A | 4/2011 |
| CN | 102787783 | A | 11/2012 |
| CN | 103015842 | A | 4/2013 |
| CN | 204571511 | U | 8/2015 |
| CN | 204609531 | U | 9/2015 |
| CN | 106760981 | A | 5/2017 |
| CN | 107035230 | A | 8/2017 |
| CN | 107060572 | A | 8/2017 |
| CN | 206468137 | U | 9/2017 |
| EP | 2278100 | A1 | 1/2011 |
| EP | 2400083 | A1 | 12/2011 |
| EP | 1468153 | B1 | 5/2012 |
| EP | 1910632 | B1 | 2/2014 |
| EP | 2865825 | A1 | 4/2015 |
| EP | 1899924 | B1 | 8/2017 |
| JP | H-1193486 | A | 4/1999 |
| WO | 2004029389 | A2 | 4/2004 |
| WO | 2006098675 | A1 | 9/2006 |
| WO | 2014148994 | A1 | 9/2014 |

* cited by examiner

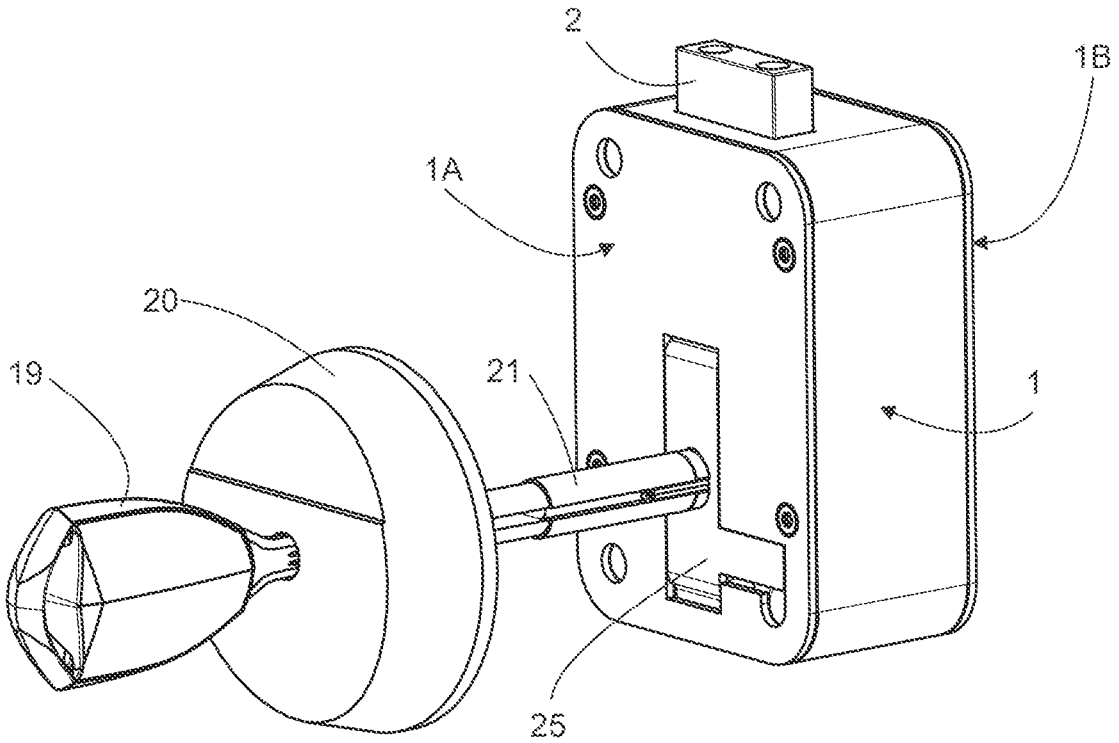
FIG. 1
FIG. 2
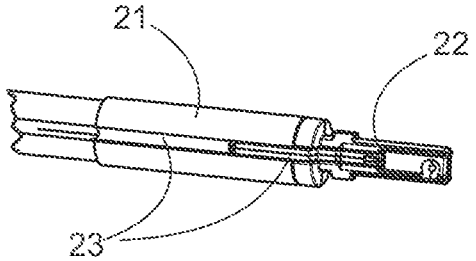
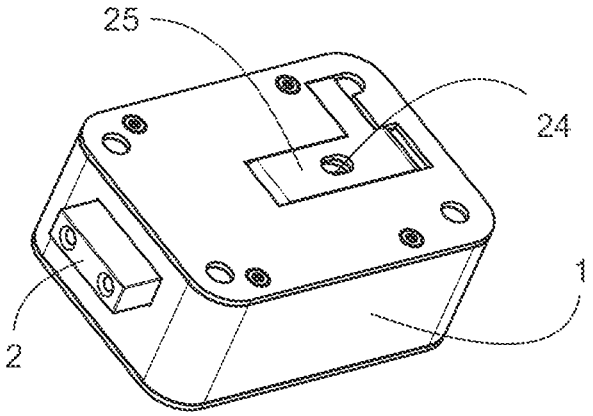
FIG. 3

LOCK

FIELD OF THE INVENTION

The invention relates to locks for ATMs, and other machines, cabinets and corresponding vaults, which require locking.

PRIOR ART

It is known to use locks in connection with for example ATMs and other various machines, whereby only accredited persons have the right to open the lock and perform necessary actions inside the machine, cabinet or corresponding vault. Such actions are for example filling an ATM with bills and collecting cash from a petrol machine or vending machine.

Such machines, cabinets and vaults can be the targets of burglary attempts, where attempts are made to manipulate the lock open using various manners. In connection with machines, cabinets and vaults it is known to use a separate locking pin, also called a re-locking pin. The locking pin locks the bolt in the locking position, if external manipulation is directed toward the lock. Thus, the bolt cannot be moved from the locking position, i.e. when its end is out of the lock, to inside the lock. The locking pin is thus used to strive to ensure that the bolt stays in the locking position, even if manipulation is directed toward the lock.

Publication CN 206468137 U describes a lock for locking cabinets. The lock has a lock frame, which comprises a bolt, and in connection with which lock frame a lock cylinder has been arranged. The lock frame further comprises a power transmission mechanism. Publication CN 204571511 U describes a lock which has a lock frame, which comprises a bolt. A lock cylinder has been arranged in connection with the lock frame. The lock frame further comprises a power transmission mechanism between the lock cylinder and the bolt. Also publication EP 2400083 A1 describes a lock which has a lock frame, which comprises a bolt. A lock cylinder has been arranged in connection with the lock frame. The lock frame of also this publication further comprises a power transmission mechanism between the lock cylinder and the bolt.

One way of manipulation is to drill the lock. Drilling strives to break the lock so that its inner locking parts, such as the deadlocking parts, can be moved, whereby the bolt can be moved out of the locking position. Various drilling protection plates are used against drilling. The protection plate either strives to completely prevent the drill from advancing further into the lock, or else it is arranged to cause the locking pin to move, so that the bolt cannot be moved from the locking position. Known locks also have parts, which when they break or are damaged due to manipulation, cause the locking pin to move, so that the bolt cannot be moved from the locking position.

Though the known solutions are functional as such, they require quite a lot of space and additionally they do not necessarily function well against other ways of manipulation, such as hits.

BRIEF DESCRIPTION OF THE INVENTION

The object of the invention is to provide an alternative solution to known locks, which additionally decreases or even eliminates the above-described problems. The lock according to the invention is achieved in the manner presented in the independent claim. The dependent claims present different embodiments of the invention.

The lock according to the invention is meant for locking cabinets, vaults and different machines. The lock has a lock frame, which comprises a bolt. A lock cylinder has been arranged in connection with the lock frame. The lock frame further comprises a power transmission mechanism between the lock cylinder and the bolt. The front part of the lock cylinder comprises a drilling protection and the rear part of the lock cylinder comprises a latch. The power transmission mechanism comprises a transmission lever and said latch. The transmission lever is connected to the latch in a rotating manner by a first point in the transmission lever and connected to the bolt in a rotating manner by a second point in the transmission lever. The transmission lever additionally comprises a retaining protrusion. The bolt comprises a locking pin and the lock frame additionally comprises a hole for the locking pin. The locking pin is spring-loaded out of the bolt, towards the hole in the locking position of the bolt. The retaining protrusion is arranged to be against the locking pin in the normal use of the lock, preventing the end of the locking pin from moving into the hole.

The connection of the lock cylinder to the lock frame and the connection of the transmission lever to the bolt is arranged to allow movement of the lock cylinder and the power transmission mechanism in the direction of the longitudinal axis of the lock cylinder. The lock also comprises a spring, which is arranged in the normal use of the lock to keep the lock cylinder and the power transmission mechanism in place in the direction of the longitudinal axis of the lock cylinder. The spring is additionally arranged to allow movement of the lock cylinder and the power transmission mechanism in the direction of the longitudinal axis of the lock cylinder due to an external hit or drilling of the lock cylinder, whereby the movement in the direction of the longitudinal axis moves the retaining protrusion away from the locking pin. Thus, the end of the locking pin moves into the hole in the locking position of the bolt.

LIST OF FIGURES

Figure 5:
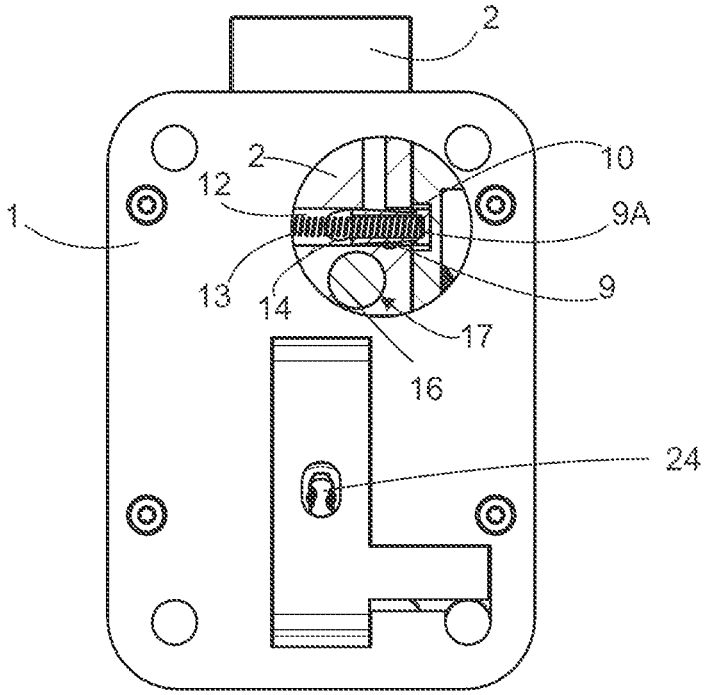
Figure 6:
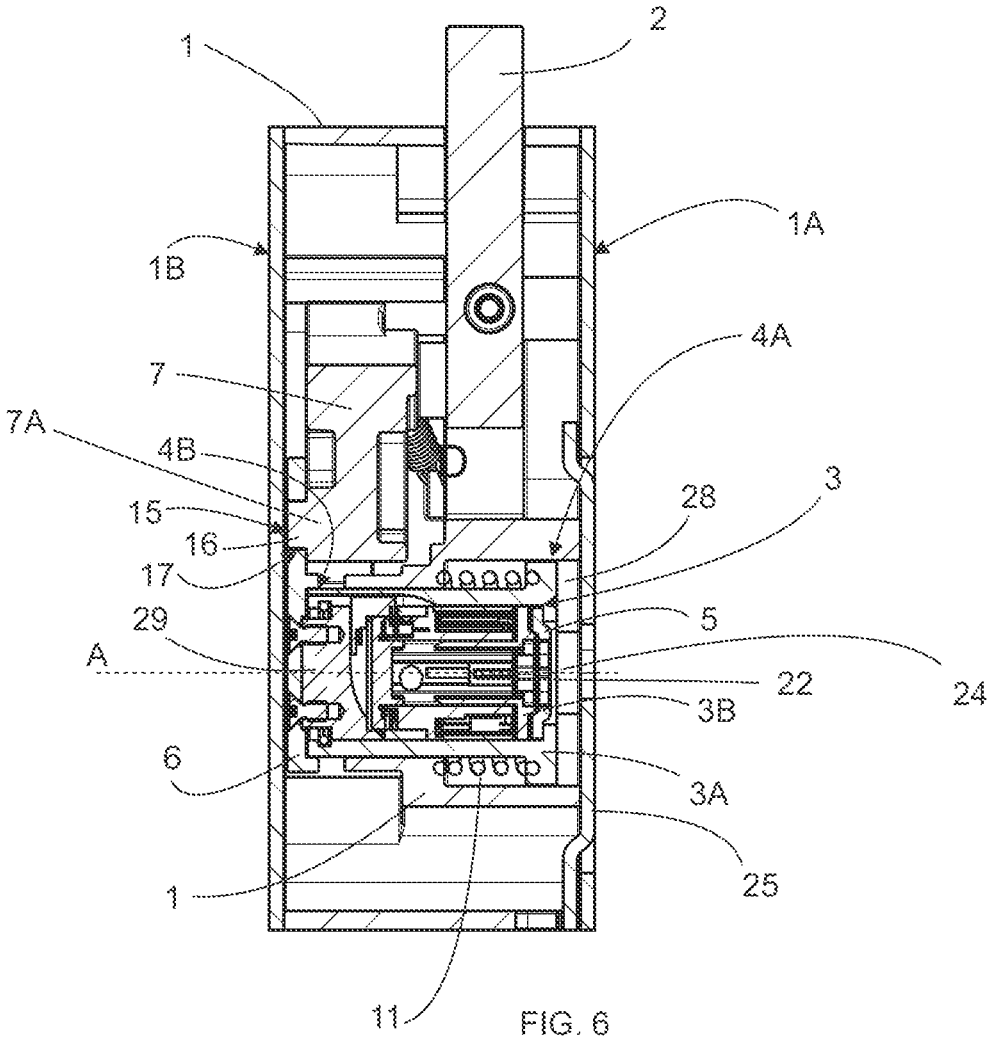
Figure 7:
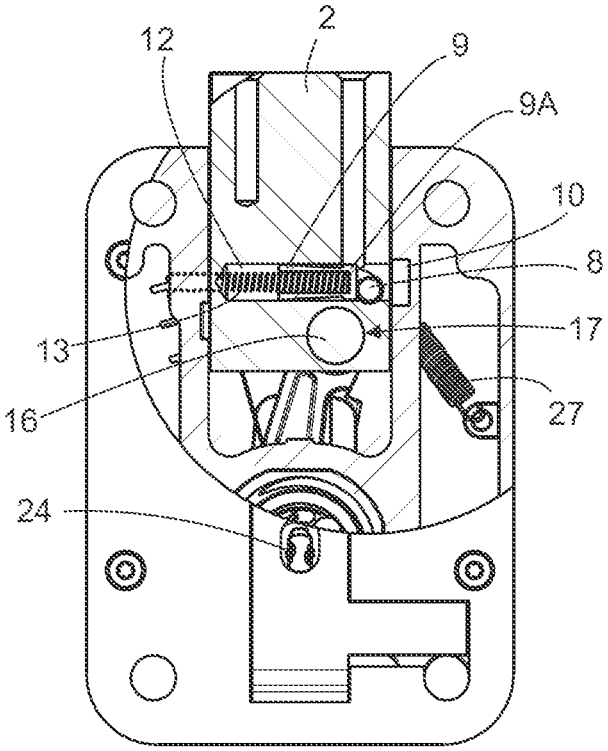

In the following, the invention will be described in more detail with reference to the appended figures, in which FIG. 1 shows an example of a lock according to the invention, FIG. 2 shows a part of the lock according to FIG. 1, FIG. 3 also shows an example of the lock according to the invention, FIG. 4 shows the example of FIG. 3 with the rear surface of the lock removed, FIG. 5 shows the example of FIG. 3 partly intersected from the front surface of the lock, FIG. 6 shows a sectional view of the lock in the example of FIG. 3, FIG. 7 shows fan example of the lock in its normal use and FIG. 8 also shows an exemplary sectional view of the normal use of the lock.

DESCRIPTION OF THE INVENTION

FIG. 1 shows an example of an embodiment of the lock according to the invention for locking cabinets, vaults and different machines. The lock has a lock frame 1 and a bolt 2. Because the walls of cabinets, vaults and machines can be comparatively thick, the lock can be equipped with a torsion link 21 by the lock cylinder 3 (FIG. 6) of the lock. To be more precise, the torsion link is by the key opening 24 of the lock cylinder and the key channel of the lock cylinder. The torsion link can be arranged to extend from the lock through the wall of the cabinet, vault or machine to the other side. It is useful that the length of the torsion link can be adjusted for example with a telescopic structure.

The lock is thus installed on the rear surface of the wall of a cabinet, vault or machine, whereby the front surface 1A of the lock is against the rear surface of the wall. The torsion link extends to the front side of the wall. There can thus be a second lock cylinder on the front side, which can be used with a key 19 and is protected by a key nest protection 20. The second lock cylinder is connected to the torsion link 21.

The second lock cylinder is not shown in the figures, but its structure can be the structure of a normal lock cylinder or else a trimmed structure without a lock-specific tumbler/tumblers. The second lock cylinder thus connects the key 19 to the torsion link. In the embodiment of FIG. 1, the lock cylinder 3 of the lock is an electric lock cylinder. Thus, the torsion link comprises an electric connection 23, via which the electric code of the key 19 can be transmitted to the lock cylinder 3. If the code i.e. the electric key is correct, the electric tumbler/tumblers of the lock cylinder make possible the turning of the key in order to open the lock. The torsion link transmits the torsion power from the key to the lock cylinder. In the embodiment of an electric lock cylinder, the torsion link 21 also comprises a key end 22, which extends into the lock cylinder 3, more precisely inside the lock cylinder 3 in its key channel. The key end has electric connections in order to open the lock. FIG. 2 shows in more detail the electric connection 23 of the torsion link and the key end 22. The front surface of the lock can have an installation plate 25, which makes it easier to install the torsion link 21.

The lock cylinder 3 of the lock can also be a mechanical lock cylinder, which comprises mechanical tumblers in the normal manner. Thus, the key shaft can be long enough that it extends through the wall of the cabinet, vault or machine into the lock cylinder in order to open it. Additionally, also an arrangement according to FIG. 1 can be used without an electric connection 23. Thus, the second lock cylinder protected by the key nest protection 20 comprises mechanical tumblers, and the torsion link 21 equipped with a key end forms a mechanical connection to the lock cylinder of the lock. In this embodiment, the lock cylinder of the lock only comprises such specific tumblers, which are arranged to function with the key end. There are thus different ways to the lock cylinder of the lock and for using it with a key.

The lock cylinder 3 of the lock and the second lock cylinder (not shown in the figures) protected with the key nest are known lock cylinders as such, whether they be electric, mechanical or possibly trimmed/simplified (e.g. their use with a key head like a key preform or the like). If the wall of the cabinet, vault or machine is not very thick, a torsion link does not necessarily need to be installed, because in this case the key 19 can extend directly to the lock cylinder 3 of the lock.

FIGS. 3-6 show an example of the lock according to the invention for locking cabinets, vaults and different machines. The lock has a lock frame 1, which comprises a bolt 2. A lock cylinder 3 has been arranged in connection with the lock frame. The lock frame further comprises a power transmission mechanism 4 between the lock cylinder and the bolt. The front part 4A of the lock cylinder comprises a drilling protection 5 and the rear part 4B of the lock cylinder comprises a latch 6. The drilling protection is for example made of tempered metal. The power transmission mechanism 4 comprises a transmission lever 7 and said latch. The lock cylinder can be turned with a therein fitting key 19 from the locking position to the open position and vice versa in a manner known as such. The lock cylinder can thus turn in relation to the lock frame. In the embodiment of the figures there is a space in the lock frame 1 for a lock cylinder 3.

The transmission lever 7 is connected to the latch 6 in a rotating manner at a first point 7A of the transmission lever and connected to the bolt 2 in a rotating manner at a second point 7B of the transmission lever. The transmission lever additionally comprises a retaining protrusion 8. The bolt comprises a locking pin 9 and the lock frame additionally comprises a hole 10 for the locking pin. The locking pin 9 is spring-loaded out of the bolt 2, towards the hole in the locking position of the bolt. The retaining protrusion 8 is arranged to be against the locking pin 9 in the normal use of the lock, preventing the end 9A of the locking pin from moving into the hole 10.

Normal use means the locking state of the lock, the open state, and the movement between these states from one state to the other. In the locking state the bolt 2 of the lock is partly out of the lock frame, as seen in the figures. It is often said that the end of the bolt is out of the lock. In the locking state of the installed lock, the end of the bolt is against the counter structure of the machine, cabinet or corresponding vault, whereby the hatch/door of the machine, cabinet or vault cannot be opened. Alternatively, the installed lock can via the bolt be connected to a separate bolt arrangement, which in turn is against the counter structure of the machine, cabinet or corresponding vault. The bolt of the lock locks the separate bolt arrangement into the locking position or guides and locks the separate bolt arrangement. The bolt 2 of a lock in the locking state can in normal use be moved into the open state by using a key 19, whereby turning the lock cylinder 3 turns the latch 6. The turning latch 6 guides the transmission lever 7 to move, which in turn moves the bolt 2 inside the lock frame 1. The lock frame has a space for moving the bolt into the lock. The bolt thus moves from the locking position to the open position, whereby also the lock moves to the open state. In the open state of the installed lock, the hatch/door of the machine, cabinet or vault can be opened. By turning the key in the opposite direction, the bolt can correspondingly be moved from the open position to the locking position, whereby the lock moves to the locking state.

The first point 7A of the transmission lever 7 is useful to arrange to be in one end of the transmission lever. The second point 7B of the transmission lever is in turn useful to arrange to be close to the opposite end of the transmission lever. It is also useful to place the retaining protrusion 8 in the opposite end. The figures show such an embodiment. The shape of the profile of the retaining protrusion 8 is for example round, but it can also be some other shape, such as a semicircle.

The connection of the lock cylinder to the lock frame 1 and the connection of the transmission lever 7 to the bolt 2 is arranged to allow movement of the lock cylinder 3 and the power transmission mechanism 4 in the direction of the longitudinal axis of the lock cylinder. The direction of the longitudinal axis is shown in the figures with a dotted line A. The lock also comprises a spring 11, which is arranged in the normal use of the lock to keep the lock cylinder 3 and the power transmission mechanism 4 in place in the direction of the longitudinal axis A of the lock cylinder. The spring 11 is additionally arranged to allow movement of the lock cylinder 3 and the power transmission mechanism 4 in the direction of the longitudinal axis of the lock cylinder due to an external hit or drilling of the lock cylinder, whereby the movement in the direction of the longitudinal axis moves the retaining protrusion 8 away from the locking pin 9. Thus, the end 9A of the locking pin moves into the hole 10 in the locking position of the bolt.

The spring 11 is arranged to be against the rear wall 1B of the lock frame by the lock cylinder, when drilling has been directed towards the lock or it has been hit with sufficient force, whereby the lock cylinder 3, the latch 6 and the transmission lever 7 have moved. From the figures can be seen how the spring 11 is arranged to be between the outer cylinder 3A of the lock cylinder and the lock frame 1. When drilling or a hit affects the inner cylinder 3B of the lock cylinder, the drilling/hit also affects the outer cylinder via the rear end 29 of the inner cylinder, whereby the lock cylinder in its entirety moves against the spring 11. FIG. 6 shows how the lock cylinder 3 has moved towards the rear surface 1B of the lock frame by the force of drilling or a hit, whereby empty space 28 is left in front of the front part 4A of the lock cylinder.

The spring 11 thus keeps the lock cylinder in place in the direction of the longitudinal axis of the lock cylinder 3 in normal use. The direction of the longitudinal axis is shown in the figures with a dotted line A. The spring simultaneously keeps the power transmission mechanism 4 in place in the direction of the longitudinal axis in normal use of the lock.

Thus, if drilling is directed towards the lock from the outside, which drilling strives to remove the locking state of the lock by drilling the lock cylinder 3, the drilling protection 5 prevents the drill bit from advancing deeper, whereby the drill must be pushed harder against the lock cylinder and lock. The purpose of the drilling protection is thus to prevent the drill bit from advancing, if it has already managed to advance from outside all the way to the drilling protection. Thus, the spring 11 flexes and the lock cylinder 3 can move in the direction of its longitudinal axis toward the rear wall 1B of the lock frame. The spring can of course flex already at an earlier stage of the drilling. Because the latch 6 is connected to the lock cylinder 3 in a fixed manner and also connected to the transmission lever 7, and the connection between the transmission lever and the bolt 2 allows the transmission lever 7 to move in the direction of the longitudinal axis of the lock cylinder, also the power transmission mechanism 4 moves at the same time towards the rear wall of the lock frame. The corresponding movement of the lock cylinder 3 and power transmission mechanism 4 occurs if a sufficiently strong external hit is directed towards the lock. The retaining protrusion 8 simultaneously moves away from the locking pin 9, whereby the locking pin moves towards the hole 10, when the bolt 2 is out, i.e. in the locking position.

As can be seen from the figures, the bolt 2 has a space 12, which has a second spring 13 and a locking pin 9. The second spring 13 pushes the locking pin 9 out of the bolt, but in the normal use of the lock the retaining protrusion 8 prevents the locking pin 9 and particularly its end 9A from moving outside the bolt. Said space is thus connected to the surface 2A of the bolt. The surface of the bolt also comprises a side groove 14, which extends into the space 12. Via the side groove the retaining protrusion 8 is against the locking pin 9 in normal use of the lock. Because the transmission lever 7 turns in relation to the bolt in normal use of the lock, the retaining protrusion 8 also moves in normal use. The side groove 14 makes this movement possible.

In the embodiment of the figures there is an axis pin joint 15 between the transmission lever 7 and the latch 6, which has an axis pin 16 and a hole 17, in which joint the axis pin is placed in the hole. The axis pin joint 15 is arranged to stay in the direction of the longitudinal axis of the lock cylinder. Thus, if the lock cylinder 3 moves in the direction of its longitudinal axis, also the transmission lever 7 moves at the same time in the direction of the longitudinal axis of the lock cylinder. The axis pin joint 15 can comprise a so-called snap-in arrangement, where the latch 6 and the transmission lever 7 are snapped together. In the embodiment of the figures, the pin 16 of the axis pin joint 15 is part of the transmission lever and the hole 17 is in the latch, but the arrangement can also be opposite, i.e. the transmission lever comprises the hole and the latch the pin.

Between the transmission lever 7 and the bolt 2 there is a second axis pin joint 16A, which has a second axis pin 17A and a second hole 18, in which joint the second axis pin 17A is placed in the hole 18. The second axis pin joint is arranged to allow the transmission lever 7 to move in relation to the bolt 2 in the direction of the longitudinal axis of the lock cylinder. The transmission lever 7 can thus slide in relation to the bolt in the direction of the longitudinal axis of the lock cylinder. In the embodiment of the figures, the pin 17A of the second axis pin joint 16A is part of the transmission lever and the hole 18 is in the bolt, but the arrangement can also be opposite, i.e. the transmission lever comprises the hole and the bolt the pin.

The connection between the latch 6 and the transmission lever 7 can also be a toggle joint arrangement, which is in locking mode when the bolt is in the locking position. The embodiments of the figures show a toggle joint. A toggle joint arrangement in the locking mode prevents the end of the bolt 2 from being pushed into the lock, because the toggle joint arrangement thus prevents the latch 6 and transmission lever 7 from turning. The figures also show a third spring 27, which is used to strive to ensure that the power transmission mechanism is in the locking position, when the bolt is in the locking position. The lock can also have a switch arrangement 26 (for example a microswitch), via which the state of the power transmission mechanism can be monitored, i.e. if it is for example in the locking position or open position.

Figure 8:
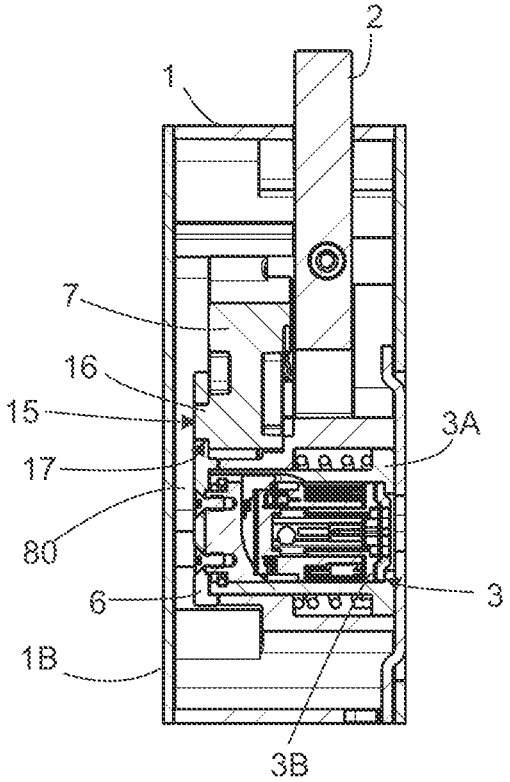

FIGS. 7 and 8 show an example of the normal use of the lock, when the bolt 2 is out in the locking position. As can be seen from the FIG. 7, the retaining protrusion 8 is arranged to be against the locking pin 9 in the normal use of the lock, preventing the end 9A of the locking pin from moving into the hole 10. FIG. 8 shows the position of the lock cylinder 3 in relation to the lock frame 1 in normal use. Thus, there is a space 80 between the latch 6 and the rear surface 1B of the lock cylinder, which makes possible the moving of the lock cylinder and the power transmission mechanism towards the rear surface 1B, if drilling or hits are directed towards the lock. As can be detected, FIGS. 4-6 show a situation, where drilling or hits have been directed towards the lock.

The invention makes possible a reliable arrangement inside a lock frame 1 for releasing a locking pin 9, if external hits or drilling are directed towards the lock.

Because the arrangement is connected to/utilizes a bolt, a power transmission mechanism and a lock cylinder, it is compact and uses only a little space. The lock according to the invention can be realized in many different ways, as can be discerned from the description above. The invention is thus not limited to the examples presented herein, but can be implemented in different ways within the scope of the independent claim.

The invention claimed is:

1. A lock for locking of cabinets, vaults and different machines, which lock has a lock frame, which comprises a bolt, and in connection with the lock frame has been arranged a lock cylinder, which lock frame additionally comprises a power transmission mechanism between the lock cylinder and the bolt, characterized in that a front part of the lock cylinder comprises a drilling protection and a rear part of the lock cylinder comprises a latch, and the power transmission mechanism comprises a transmission lever and said latch, which transmission lever is connected to the latch in a rotating manner at a first point of the transmission lever and connected to the bolt in a rotating manner at a second point of the transmission lever, which transmission lever additionally comprises a retaining protrusion, and the bolt comprises a locking pin and the lock frame comprises a hole for the locking pin, which locking pin is spring-loaded out of the bolt, towards the hole in the locking position of the bolt, and which retaining protrusion is arranged to be against the locking pin in the normal use of the lock, preventing an end of the locking pin from moving into the hole, both the connection of the lock cylinder to the lock frame and the connection of the transmission lever to the bolt is arranged to allow movement of the lock cylinder and the power transmission mechanism in the direction of the longitudinal axis of the lock cylinder, which lock additionally comprises a spring, which is arranged to keep the lock cylinder and power transmission mechanism in place in the direction of the longitudinal axis of the lock cylinder in normal use of the lock and to allow movement in the direction of the longitudinal axis due to an external hit or drilling of the lock cylinder, whereby the movement in the direction of the longitudinal axis moves the retaining protrusion away from the locking pin, whereby the end of the locking pin moves into the hole in the locking position of the bolt.

2. The lock according to claim 1, wherein the bolt has a space, which has a second spring and the locking pin, which second spring pushes the locking pin out of the bolt.

3. The lock according to claim 2, wherein a surface of the bolt comprises a side groove, which extends into the space, and via which side groove the retaining protrusion is against the locking pin in normal use of the lock.

4. The lock according to claim 3, wherein there is an axis pin joint between the transmission lever and the latch, which has an axis pin and a hole, in which axis pin joint the axis pin is placed in the hole, which axis pin joint is arranged to stay during movement in the direction of the longitudinal axis of the lock cylinder, whereby also the transmission lever moves in the direction of the longitudinal axis of the lock cylinder.

5. The lock according to claim 4, wherein there is a second axis pin joint between the transmission lever and the bolt, which has a second axis pin and a second hole, in which joint the axis pin is placed in the hole, which second axis pin joint is arranged to allow movement of the transmission lever in relation to the bolt in the direction of the longitudinal axis of the lock cylinder.

6. The lock according to claim 5, wherein the connection between the latch and the transmission lever is a toggle joint arrangement, which arrangement is in locking mode when the bolt is in the locking position.

7. The lock according to claim 1, wherein the drilling protection is made of tempered metal.

8. The lock according to claim 1, wherein it comprises a torsion link by the lock cylinder, which torsion link is arrangeable to extend from the lock through the wall of the cabinet, vault or machine to the other side.

9. The lock according to claim 8, wherein the torsion link comprises a key end, which extends to the lock cylinder.

* * * * *